US009764447B2

(12) United States Patent
Beckman et al.

(10) Patent No.: US 9,764,447 B2
(45) Date of Patent: Sep. 19, 2017

(54) SYSTEMS AND METHODS FOR POLISHING AIRFOILS

(71) Applicant: United Technologies Corporation, Hartford, CT (US)

(72) Inventors: Micah Beckman, Middletown, CT (US); Robert E. Erickson, Storrs, CT (US); Daniel Livchitz, West Hartford, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 0 days.

(21) Appl. No.: 15/048,595

(22) Filed: Feb. 19, 2016

(65) Prior Publication Data

US 2016/0167196 A1 Jun. 16, 2016

Related U.S. Application Data

(63) Continuation of application No. PCT/US2014/060728, filed on Oct. 15, 2014.

(60) Provisional application No. 61/896,523, filed on Oct. 28, 2013.

(51) Int. Cl.

| | |
|---|---|
| ***B24C 1/08*** | (2006.01) |
| ***B24B 19/14*** | (2006.01) |
| ***B24B 31/116*** | (2006.01) |
| ***B24C 3/32*** | (2006.01) |

(52) U.S. Cl.

CPC ..... *B24C 1/083* (2013.01); *B24B 19/14* (2013.01); *B24B 31/116* (2013.01); *B24C 3/327* (2013.01)

(58) Field of Classification Search

CPC ..... B24B 19/14; B24B 31/116; B24C 3/327
USPC ..... 451/1, 36–38, 104, 113, 364, 365, 381
See application file for complete search history.

(56) References Cited

U.S. PATENT DOCUMENTS

| | | | | |
|---|---|---|---|---|
| 2,612,082 A * | 9/1952 | Angell | B23Q 3/063 | 164/207 |
| 3,331,166 A * | 7/1967 | Brenning | B24B 41/06 | 269/152 |
| 3,823,514 A | 7/1974 | Tsuchiya | | |
| 4,005,549 A | 2/1977 | Perry | | |
| 4,400,915 A * | 8/1983 | Arrigoni | B23P 6/002 | 29/889.1 |

(Continued)

FOREIGN PATENT DOCUMENTS

| | | |
|---|---|---|
| EP | 1426141 | 6/2004 |
| WO | 2014143302 | 9/2014 |
| WO | 2015006329 | 1/2015 |

OTHER PUBLICATIONS

International Search Report and Written Opinion dated Mar. 20, 2015 in Application No. PCT/US2014/060728.

(Continued)

*Primary Examiner* — George Nguyen
(74) *Attorney, Agent, or Firm* — Snell & Wilmer, L.L.P.

(57) ABSTRACT

A sleeve may be configured to secure an airfoil cluster for polishing. The sleeve may include a mock airfoil and a bypass flow path between the mock airfoil and an end wall of the sleeve. The sleeve may be positioned in an annular ring of sleeves in a polishing apparatus. The polishing apparatus may comprise an annular flow path for an abrasive fluid. The abrasive fluid may be flowed through the annular ring of sleeves in order to polish the airfoil cluster.

20 Claims, 6 Drawing Sheets

(56) References Cited

U.S. PATENT DOCUMENTS 4,447,992 A * 5/1984 Bergquist ..... B24B 41/06 451/29
4,589,175 A * 5/1986 Arrigoni ..... B23P 6/002 29/402.18
4,689,921 A * 9/1987 Murate ..... B24B 31/003 451/106
5,176,499 A * 1/1993 Damlis ..... B23P 15/04 29/888.024
5,341,602 A * 8/1994 Foley ..... B24B 31/116 451/113
5,868,930 A * 2/1999 Kopf ..... B01D 63/084 210/231
6,186,867 B1 * 2/2001 Dwyer ..... B23Q 3/063 269/296
6,764,384 B1 * 7/2004 Kleer ..... B24B 31/064 451/104
6,780,089 B2 * 8/2004 Pan ..... B24B 31/006 451/113
7,303,461 B1 * 12/2007 Campomanes ..... B24B 1/00 451/214
7,758,405 B2 * 7/2010 Bunce ..... B23B 31/16275 451/365
8,016,644 B2 * 9/2011 Curodeau ..... B24B 1/04 451/165
8,657,647 B2 * 2/2014 Baudimont ..... B24B 31/003 451/113
9,193,111 B2 * 11/2015 Soucy ..... B29C 67/0077
2003/0027495 A1 * 2/2003 Shaw ..... B24C 1/04 451/29
2004/0077293 A1 * 4/2004 Kostar ..... B24B 1/04 451/36
2011/0047777 A1 * 3/2011 Soucy ..... B24B 31/00 29/525.01
2013/0052030 A1 * 2/2013 McCaffrey ..... F01D 5/147 416/241 B
2014/0273757 A1 9/2014 Beckman et al.

OTHER PUBLICATIONS

International Preliminary Report on Patentability dated May 3, 2016 in Application No. PCT/US2014/060728.

Partial European Search Report dated May 9, 2017 in European Application No. 14859159.7.

* cited by examiner

SYSTEMS AND METHODS FOR POLISHING AIRFOILS

CROSS-REFERENCE TO RELATED APPLICATIONS

This application is a continuation of, claims priority to and the benefit of, PCT/US2014/060728 filed on Oct. 15, 2014 and entitled "SYSTEM AND METHOD FOR POLISHING AIRFOILS," which claims priority from U.S. Provisional Application No. 61/896,523 filed on Oct. 28, 2013 and entitled "SYSTEM AND METHOD FOR POLISHING AIRFOILS." Both of the aforementioned applications are incorporated herein by reference in their entirety.

FIELD OF INVENTION

The present disclosure relates generally to gas turbine engines. More particularly, the present disclosure relates to polishing gas turbine engine components.

BACKGROUND OF THE INVENTION

Gas turbine engines (such as those used in electrical power generation or used in modern aircraft) typically include a compressor, a combustion section, and a turbine. The compressor and the turbine typically include a series of alternating rotors and stators. The stators may be manufactured by a direct metal laser sintering process. The stators may be polished in order to remove non-uniformities on the stators.

SUMMARY OF THE INVENTION

A polishing assembly may include a first distributor plate, a first carrier plate, a second carrier plate, and a second distributor plate. The first carrier plate may be coupled to the first distributor plate. The first carrier plate may comprise a first receiving slot. The second carrier plate may comprise a second receiving slot. The second carrier plate may be located between the first carrier plate and the second distributor plate.

A method of polishing an airfoil cluster may comprise positioning an airfoil cluster within a sleeve. The method may include positioning the sleeve within a receiving slot in a polishing assembly. The method may include directing an annular flow of an abrasive fluid through the sleeve.

A sleeve for polishing an airfoil cluster may comprise an inner shroud, an outer shroud, a first end wall, a second end wall, a first mock airfoil, and a second mock airfoil. The first end wall may extend between the inner shroud and the outer shroud. The second end wall may extend between the inner shroud and the outer shroud. The first mock airfoil may extend between the inner shroud and the outer shroud. The second mock airfoil may extend between the inner shroud and the outer shroud.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be exemplary in nature and non-limiting.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the drawing figures.

DETAILED DESCRIPTION

The detailed description of various embodiments herein makes reference to the accompanying drawings, which show various embodiments by way of illustration. While these various embodiments are described in sufficient detail to enable those skilled in the art to practice the disclosure, it should be understood that other embodiments may be realized and that logical, chemical, and mechanical changes may be made without departing from the spirit and scope of the disclosure. Thus, the detailed description herein is presented for purposes of illustration only and not of limitation. For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, connected, or the like may include permanent, removable, temporary, partial, full, and/or any other possible attachment option. Additionally, any reference to without contact (or similar phrases) may also include reduced contact or minimal contact.

Figure 1:
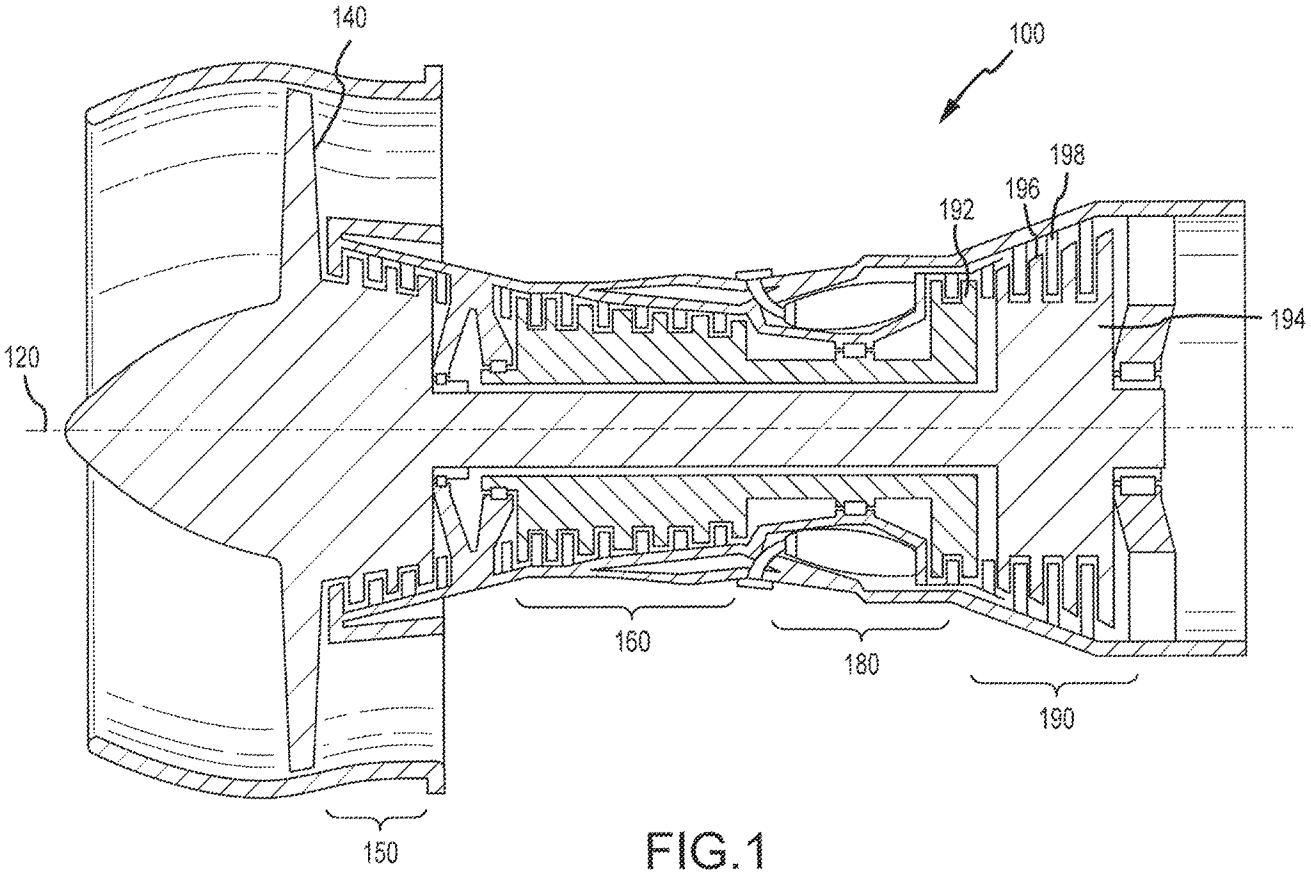
FIG. 1 illustrates a schematic cross-section view of a gas turbine engine in accordance with various embodiments.

Referring to FIG. 1, a gas turbine engine 100 (such as a turbofan gas turbine engine) is illustrated according to various embodiments. Gas turbine engine 100 is disposed about axial centerline axis 120, which may also be referred to as axis of rotation 120. Gas turbine engine 100 may comprise a fan 140, compressor sections 150 and 160, a combustion section 180, and a turbine section 190. Air compressed in the compressor sections 150, 160 may be mixed with fuel and burned in combustion section 180 and expanded across turbine section 190. Turbine section 190 may include high pressure rotors 192 and low pressure rotors 194, which rotate in response to the expansion. Turbine section 190 may comprise alternating rows of rotary airfoils or blades 196 and static airfoils or vanes 198. FIG. 1 provides a general understanding of the sections in a gas turbine engine, and is not intended to limit the disclosure. The present disclosure may extend to all types of turbine engines, including turbofan gas turbine engines and turbojet engines, for all types of applications.

The forward-aft positions of gas turbine engine 100 lie along axis of rotation 120. For example, fan 140 may be referred to as forward of turbine section 190 and turbine section 190 may be referred to as aft of fan 140. Typically, during operation of gas turbine engine 100, air flows from forward to aft, for example, from fan 140 to turbine section 190. As air flows from fan 140 to the more aft components of gas turbine engine 100, axis of rotation 120 may also generally define the direction of the air stream flow.

Figure 2:
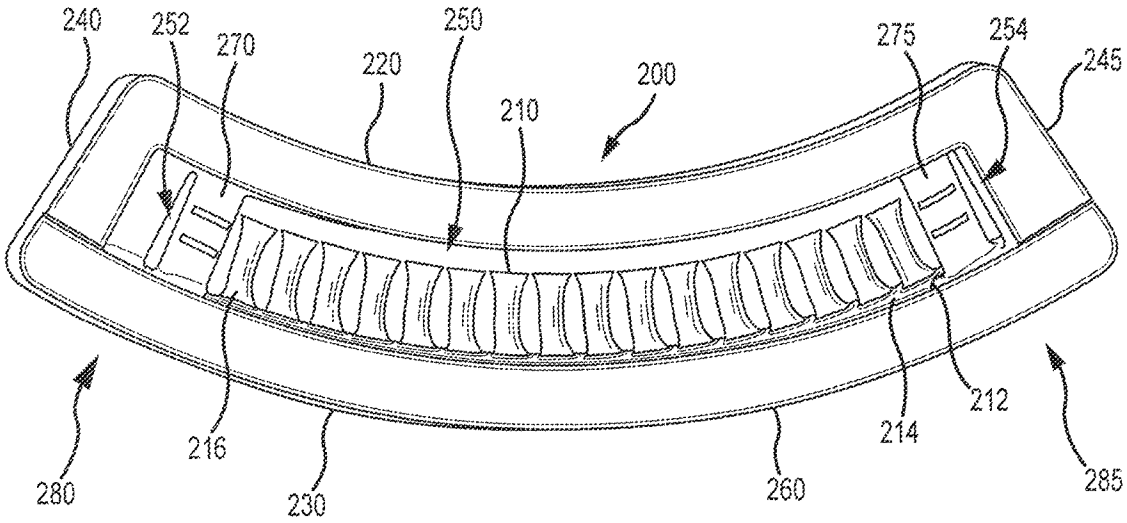
FIG. 2 illustrates a perspective view of a sleeve with an airfoil cluster in accordance with various embodiments.

Referring to FIG. 2, a perspective view of a sleeve 200 for polishing an airfoil cluster 210 is illustrated according to various embodiments. Sleeve 200 may comprise an inner shroud 220, an outer shroud 230, a first end wall 240 extending between inner shroud 220 and outer shroud 230, and a second end wall 245 extending between inner shroud 220 and outer shroud 230. In various embodiments, inner shroud 220, outer shroud 230, first end wall 240, and second end wall 245 may comprise a single component. However, in various embodiments, any number of components may be coupled together to form sleeve 200. In various embodiments, inner shroud 220 and outer shroud 230 may comprise circular arcs. Inner shroud 220 and outer shroud 230 may be concentric, and inner shroud 220 may comprise a radius smaller than a radius of outer shroud 230.

Inner shroud 220, outer shroud 230, first end wall 240, and second end wall 245 may define a sleeve flow path 250 for an abrasive fluid used to polish airfoil cluster 210. Sleeve 200 may be configured to retain airfoil cluster 210. In various embodiments, a lip 212 of airfoil cluster 210 may be positioned adjacent to outer shroud 230. A retaining plate 260 may be coupled to outer shroud 230 in order to secure airfoil cluster 210 within sleeve 200. Retaining plate 260 may clamp lip 212 between retaining plate 260 and outer shroud 230.

Sleeve 200 may further comprise a first mock airfoil 270 and a second mock airfoil 275. First mock airfoil 270 and second mock airfoil 275 may extend between inner shroud 220 and outer shroud 230. First mock airfoil 270 may be located at a first end 280 of sleeve 200, and second mock airfoil 275 may be located at a second end 285 of sleeve 200. First mock airfoil 270, inner shroud 220, outer shroud 230, and first end wall 240 may define a first bypass flow path 252. Second mock airfoil 275, inner shroud 220, outer shroud 230, and second end wall 245 may define a second bypass flow path 254. A bypass flow path may be a region of sleeve flow path 250, wherein abrasive fluid in the bypass flow path does not contact airfoil cluster 210.

In various embodiments, airfoil cluster 210 may comprise a segment of a stage of a turbine stator for a gas turbine engine. However, in various embodiments, airfoil cluster may comprise any type of component having airfoils. In various embodiments, airfoil cluster 210 may be manufactured using direct metal laser sintering ("DMLS"). DMLS may comprise fusing metal powder into a solid part by melting it locally using a laser. Airfoil cluster 210 may comprise platform 214 and airfoils 216. In various embodiments, airfoils 216 may be cantilevered from platform 214. In various embodiments, airfoil cluster 210 may be positioned in sleeve flow path 250 of sleeve 200 between first mock airfoil 270 and second mock airfoil 275.

Figure 3:
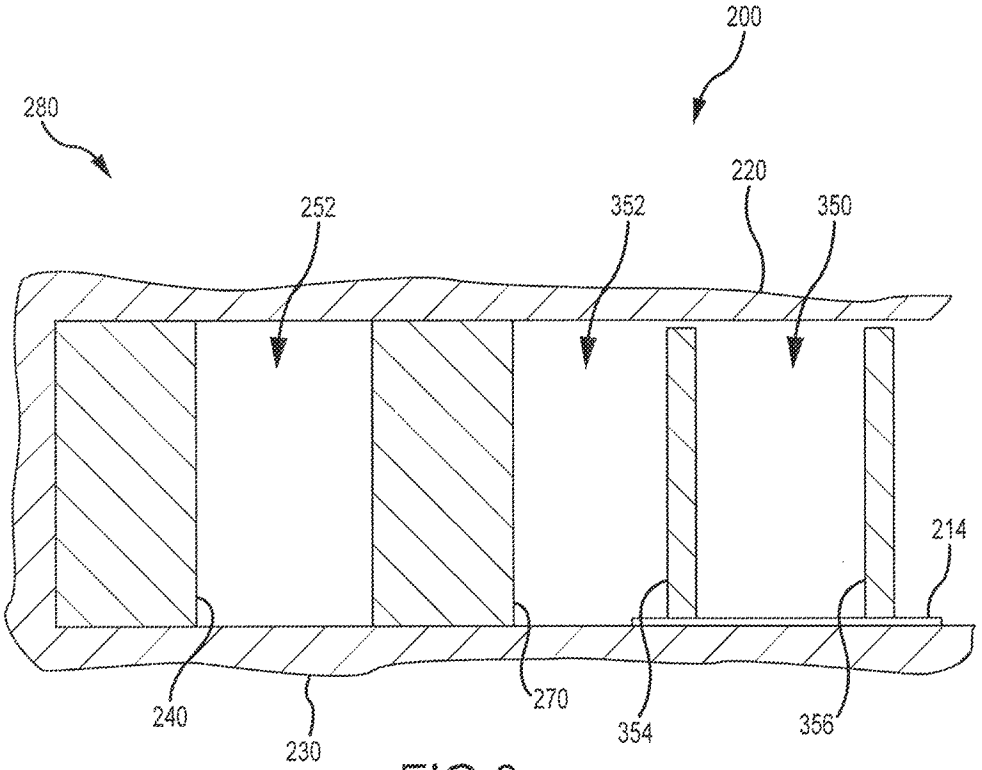
FIG. 3 illustrates a cross-section view of a first end of a sleeve in accordance with various embodiments.

Referring to FIG. 3, a cross-section view of first end 280 of sleeve 200 is illustrated according to various embodiments. An abrasive fluid may be flowed through sleeve 200 through inter-airfoil region 350, mock airfoil region 352, and through first bypass flow path 252. Inter-airfoil region 350 may be defined by a first airfoil 354, a second airfoil 356, platform 214, and inner shroud 220. In various embodiments, first airfoil 354 may be the airfoil of airfoil cluster 210 which is closest in distance to first mock airfoil 270. Mock airfoil region 352 may be defined as the region bounded by first airfoil 354, first mock airfoil 270, inner shroud 220, and platform 214 and/or outer shroud 230. Bypass flow path 252 may be defined as the region bounded by mock airfoil 270, first end wall 240, inner shroud 220, and outer shroud 230.

In various embodiments, applying a constant pressure to the abrasive fluid may cause the abrasive fluid to flow through sleeve 200 at differing velocities at differing locations of sleeve 200. For example, at contact locations where abrasive fluid contacts sleeve 200 and/or airfoil cluster 210, frictional interaction between the abrasive fluid and sleeve 200 and/or airfoil cluster 210 may decrease the velocity of the abrasive fluid at such contact locations. Similarly, a viscosity of the abrasive fluid may result in abrasive fluid at such contact locations decreasing the kinetic energy and hence velocity of adjacent abrasive fluid. In contrast, at locations comparatively further from components of sleeve 200 and/or airfoil cluster 210, the abrasive fluid may experience a smaller frictional force, and thus may flow through sleeve 200 at a relatively higher velocity.

In various embodiments, differing velocities of the abrasive fluid may result in airfoils 216 being polished at different rates. The abrasive fluid may experience the greatest friction drag at locations adjacent to first end wall 240. Thus, in various embodiments, the abrasive fluid may have a relatively lower velocity at locations adjacent to first end wall. The friction drag at first end wall 240 may cause the abrasive fluid to have a lower velocity at first airfoil 354 relative to the velocity of the abrasive fluid at second airfoil 356, resulting in first airfoil 354 being polished at a different rate than second airfoil 356.

However, in various embodiments, mock airfoil 270 may be configured such that the velocity of the abrasive fluid at first airfoil 354 is substantially equal to the velocity of the abrasive fluid at second airfoil 356. In various embodiments, mock airfoil 270 may be positioned such that a cross-sectional area of mock airfoil region 352 is substantially equal to a cross-sectional area of inter-airfoil region 350. Additionally, in various embodiments, the cross-sectional area of mock airfoil region 352 may be substantially to a cross-sectional area of bypass flow path 252. In various embodiments, the effect of the frictional drag on the abrasive fluid at first end wall 240 may be negligible at first airfoil 354 due to the bypass flow path 252 and the mock airfoil region 352. Thus, the velocity of the abrasive fluid through mock airfoil region 352 may be substantially equal to the velocity of the abrasive fluid through interairfoil region 350. Therefore, first airfoil 354 and second airfoil 356 may be polished at substantially the same rate.

Figure 4:
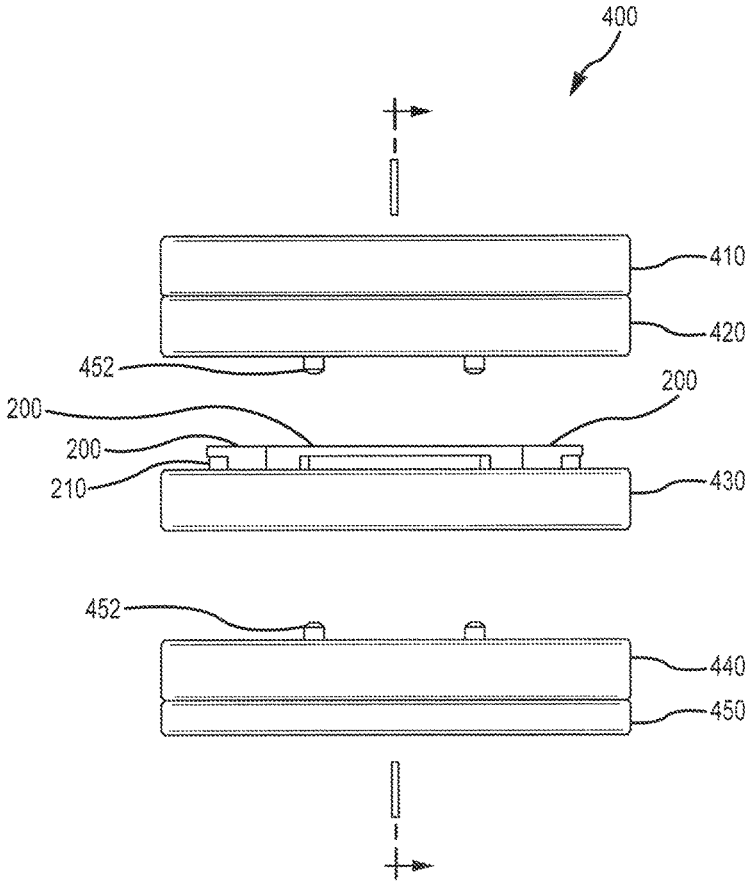
FIG. 4 illustrates a side view of a polishing assembly in accordance with various embodiments.

Referring to FIG. 4, a side view of a polishing apparatus 400 is illustrated according to various embodiments. In various embodiments, polishing apparatus 400 may be configured to be used with an abrasive flow machine. In abrasive flow machining, an abrasive fluid (such as a polishing putty) may be forced through a workpiece (such as airfoil cluster 210) using a hydraulic ram. Abrasive particles in the abrasive fluid may contact raised features on the surface of airfoil cluster 210 and remove them. In various embodiments, abrasive flow machining may be a two-way process, wherein the abrasive fluid is forced through airfoil cluster 210 in a first direction, then the direction of flow of abrasive fluid 210 may be reversed. The direction of flow may be reversed multiple times until the desired amount of polishing is completed.

Polishing apparatus 400 may comprise an upper distributor plate 410, an upper carrier 420, a lower carrier 430, a lower distributor plate 440, and a support plate 450. In various embodiments, at least one of upper distributor plate 410, upper carrier 420, lower carrier 430, and lower distributor plate 440 may comprise nylon. In various embodiments, support plate 450 may comprise a metal alloy, such as stainless steel. Support plate 450 may provide strength to polishing apparatus 400. Upper distributor plate 410 and lower distributor plate 440 may be configured to receive abrasive fluid from an abrasive flow machine and direct the abrasive fluid to a desired flow path. Upper carrier 420 and lower carrier 430 may be configured to receive one or more sleeves 200 and further direct the abrasive fluid through sleeve flow path 250 as described with reference to FIG. 2. In various embodiments, at least one of upper carrier 420, lower carrier 430, and lower distributor plate 440 may comprise alignment pegs 452, which may be inserted into corresponding alignment holes in order to properly align lower carrier 430 within polishing apparatus 400.

Figure 5:
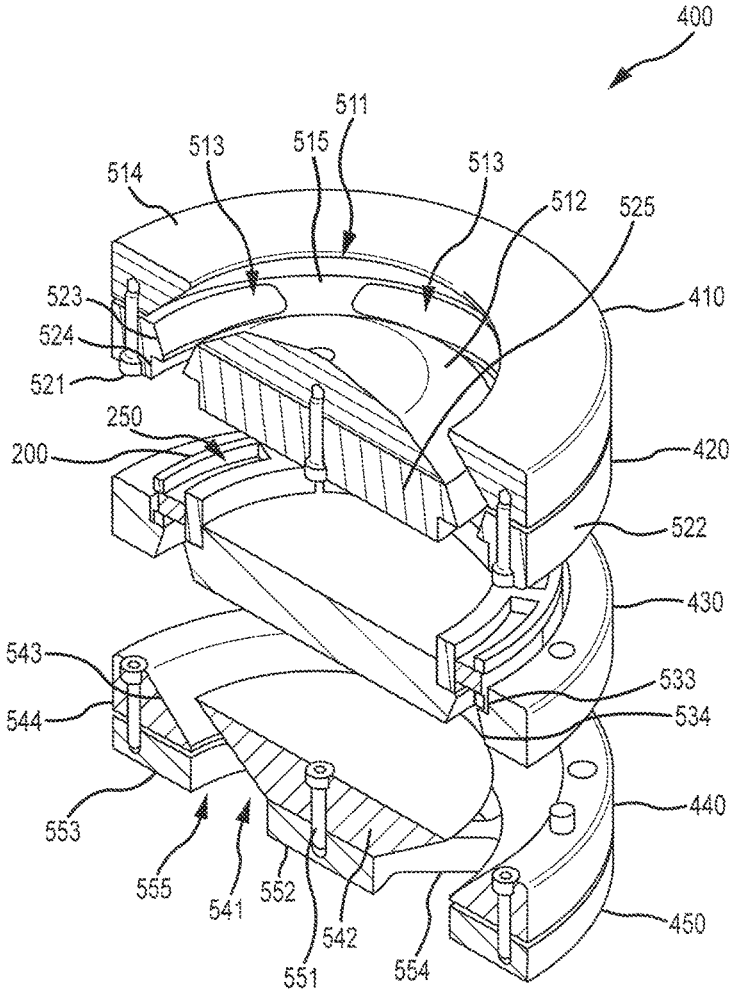
FIG. 5 illustrates a perspective view of a section of a polishing assembly in accordance with various embodiments.

Referring to FIG. 5, a perspective section view of polishing apparatus 400 is illustrated according to various embodiments. In various embodiments, polishing apparatus 400 may be an annular polishing apparatus, wherein abrasive fluid is generally distributed to an annular flow path and forced through a working piece to be polished. Upper distributor plate 410 may comprise an upper inlet 511, wherein abrasive fluid from an abrasive flow machine may enter and/or exit polishing apparatus 400. Upper distributor plate 410 may further comprise an upper distributing cone 512 which is configured to distribute the abrasive fluid to distributing flow paths 513. Upper distributing cone 512 may be coupled to upper distributor plate periphery 514 via braces 515. In various embodiments, distributing flow paths 513 may be defined by upper distributor plate periphery 514, braces 515, and upper distributing cone 512. In various embodiments, distributing flow paths 513 may each comprise a segment of an annular ring.

In various embodiments, upper carrier plate 420 may be coupled to upper distributor plate 410. In various embodiments, upper carrier plate 420 may be coupled to upper distributor plate 410 via bolts 521. Upper carrier plate 420 may comprise a central carrier 525 and a peripheral carrier 522. In various embodiments, central carrier 525 may be coupled to peripheral carrier 522 via braces. Central carrier 525 and peripheral carrier 522 may define directional flow paths 523 and receiving slot 524. Receiving slot 524 may be configured to receive at least one sleeve 200. Directional flow paths 523 may be configured to direct the abrasive fluid exiting distributing flow paths 513 into sleeve flow paths 250.

In various embodiments, lower carrier plate 430 may be similar to upper carrier plate 420. However, lower carrier plate 430 may face in the opposite direction as upper carrier plate 420, such that receiving slot 533 in lower carrier plate 430 faces receiving slot 523 in upper carrier plate 420. In the illustrated embodiment, receiving slot 533 is configured to receive four sleeves 200. However, in various embodiments, receiving slot 533 may be configured to receive any number of sleeves 200. Sleeves 530 may be positioned in an annular ring in receiving slot 533 in the path of the abrasive fluid. In various embodiments, the arrangement of sleeves 200 may be axisymmetric. The axisymmetric arrangement may allow for annular flow of the abrasive fluid. Lower carrier plate 430 may further comprise directional flow paths 534 which may align with sleeve flow paths 250.

In various embodiments, lower distributor plate 440 may be similar to upper distributor plate 410. Lower distributor plate 440 may comprise a lower inlet 541, wherein abrasive fluid from the abrasive flow machine may enter polishing apparatus 400 through support plate 450. Lower distributor plate 440 may further comprise a lower distributing cone 542 which is configured to distribute the abrasive fluid to a distributing flow path 543. In various embodiments, lower distributing cone 542 may be coupled to lower distributor plate periphery 544 via braces. However, in various embodiments, lower distributing cone 542 may not be directly coupled to lower distributor plate periphery 544. In various embodiments, distributing flow path 543 may be defined by lower distributor plate periphery 544 and lower distributing cone 542.

In various embodiments, support plate 450 may be coupled to lower distributor plate 440. In various embodiments, support plate 450 may be coupled to lower distributor plate 440 via bolts 551. Support plate 450 may comprise central support 552 and peripheral support 553. In various embodiments, central support 552 may be coupled to peripheral support 553 via support braces 554. In various embodiments, central support 552 may be coupled to lower distributing cone 542, and peripheral support may be coupled to lower distributor plate periphery 544. In various embodiments, central support 552, peripheral support 553, and support braces 554 may define support flow paths 555. The abrasive fluid may enter and/or exit polishing assembly 400 through support flow paths 555.

Figure 6:
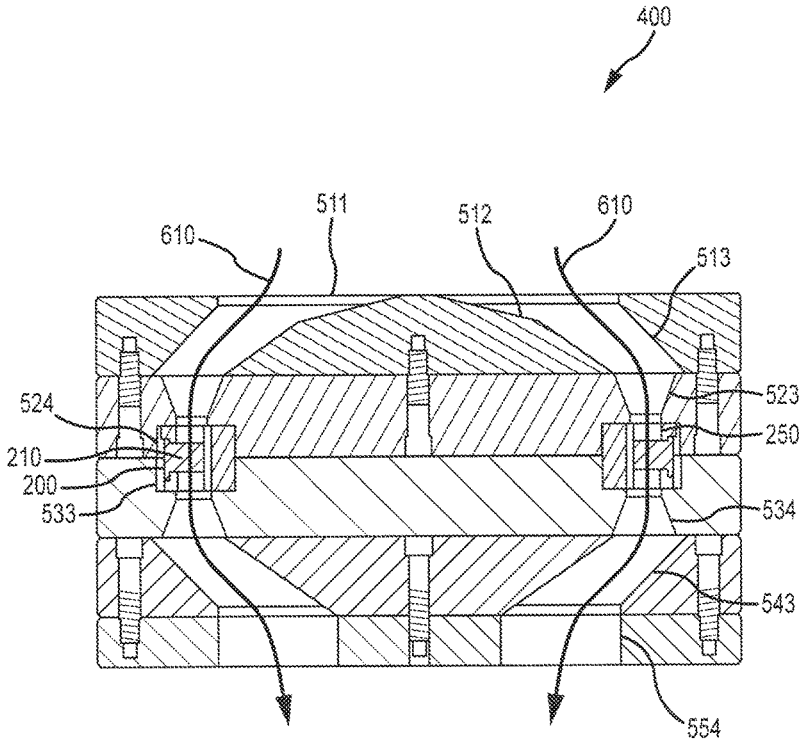
FIG. 6 illustrates a cross-section view of a polishing assembly in accordance with various embodiments.

In various embodiments, sleeves 230 may be quickly replaced in order to polish large quantities of airfoil clusters 210. During abrasive flow, upper carrier 420 and lower carrier 430 may secure sleeves 200 within receiving slot 523 and receiving slot 533 as illustrated in FIG. 6. However, in order to change sleeves 200, upper carrier 420 may be separated from lower carrier 430, and sleeves 200 may be lifted out of receiving slot 533, either by human or machine, and additional sleeves may be placed within receiving slot 533. Upper carrier 420 and lower carrier 430 may be pressed back together, and abrasive fluid may be forced through polishing apparatus 400 in order to polish airfoil clusters secured within the additional sleeves.

Referring to FIG. 6, a cross-section view of polishing apparatus 400 is illustrated according to various embodiments. Airfoil cluster 210 may be positioned within sleeve 200. Sleeve 200 may be positioned within receiving slot 524 and receiving slot 533. An annular flow of abrasive fluid may be directed through polishing apparatus 400 as indicated by directional arrows 610. In various embodiments, the abrasive fluid may be driven by a ram of an abrasive flow machine. The abrasive fluid may enter polishing apparatus at upper inlet 511. The abrasive fluid may be directed into distributing flow paths 513 by upper distributing cone 512. The abrasive fluid may be directed into directional flow paths 523, and directional flow paths 523 may direct the abrasive fluid into sleeve flow path 250. In sleeve flow path 250, the abrasive fluid may polish airfoil cluster 210. The abrasive fluid may continue into directional flow path 534, distributing flow path 543, and out support flow paths 554. After a set amount of time, the direction of flow of the abrasive fluid may be reversed. The direction of flow may be reversed any number of times until the desired amount of polishing has been completed.

Benefits, other advantages, and solutions to problems have been described herein with regard to specific embodiments. Furthermore, the connecting lines shown in the various FIGS. contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

Systems, methods and apparatus are provided herein. In the detailed description herein, references to "one embodiment", "an embodiment", "various embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

The invention claimed is:

1. A polishing assembly comprising:
a first distributor plate;
a first carrier plate coupled to the first distributor plate, the first carrier plate comprising a first receiving slot;
a second carrier plate comprising a second receiving slot;
a second distributor plate, wherein the second carrier plate is located between the first carrier plate and the second distributor plate; and
a sleeve positioned within the first receiving slot and the second receiving slot, wherein an airfoil cluster is secured within the sleeve.

2. The polishing assembly of claim 1, wherein the sleeve comprises a mock airfoil.

3. The polishing assembly of claim 1, wherein the first distributor plate comprises a first distributing cone, and wherein the second distributor plate comprises a second distributing cone.

4. The polishing assembly of claim 1, further comprising a support plate coupled to the second distributor plate.

5. The polishing assembly of claim 4, wherein the support plate comprises steel.

6. The polishing assembly of claim 1, wherein at least one of the first distributor plate, the first carrier, the second carrier, and the second distributor plate comprise nylon.

7. The polishing assembly of claim 1, wherein the first distributing cone is coupled to a distributor plate periphery via a brace.

8. The polishing assembly of claim 7, wherein the first distributing cone, the distributor plate periphery, and the brace define a distributing flow path.

9. The polishing assembly of claim 1, wherein the first carrier plate further comprises a directional flow path.

10. The polishing assembly of claim 9, wherein the directional flow path is configured to direct abrasive fluid from the first distributor plate through a sleeve flow path in the sleeve located within the first receiving slot and the second receiving slot.

11. A method of polishing an airfoil cluster comprising:
positioning the airfoil cluster within a sleeve and between two mock airfoils in the sleeve;
positioning the sleeve within a receiving slot in a polishing assembly; and
directing an annular flow of an abrasive fluid through the sleeve.

12. The method of claim 11, further comprising directing the abrasive fluid through a bypass flow path in the sleeve.

13. The method of claim 11, wherein the sleeve is one of a plurality of sleeves, and wherein the method further includes positioning the plurality of sleeves in an annular arrangement within the receiving slot and a second receiving slot.

14. The method of claim 11, further comprising reversing a flow direction of the abrasive fluid.

15. The method of claim 11, wherein the airfoil cluster comprises a turbine stator segment for a gas turbine engine.

16. A sleeve for polishing an airfoil cluster comprising:
an inner shroud;
an outer shroud;
a first end wall extending between the inner shroud and the outer shroud;
a second end wall extending between the inner shroud and the outer shroud;
a first mock airfoil extending between the inner shroud and the outer shroud; and
a second mock airfoil extending between the inner shroud and the outer shroud.

17. The sleeve of claim 16, wherein the first mock airfoil, the first end wall, the inner shroud, and the outer shroud define a bypass flow path for an abrasive flow path.

18. The sleeve of claim 16, further comprising an airfoil cluster coupled to the outer shroud and positioned between the first mock airfoil and the second mock airfoil.

19. A method of polishing an airfoil cluster comprising:
positioning the airfoil cluster within a sleeve;
positioning the sleeve within a receiving slot in a polishing assembly;
directing an annular flow of an abrasive fluid through the sleeve; and
directing the abrasive fluid through a bypass flow path in the sleeve.

20. A method of polishing an airfoil cluster comprising:
positioning the airfoil cluster within a sleeve, wherein the airfoil cluster comprises a turbine stator segment for a gas turbine engine;
positioning the sleeve within a receiving slot in a polishing assembly; and directing an annular flow of an abrasive fluid through the sleeve.

* * * * *